US006128970A

United States Patent [19]

Kim

[11] Patent Number: 6,128,970

[45] Date of Patent: Oct. 10, 2000

[54] FORCE FEED BACK MANIPULATOR EMPLOYING WIRES AND SPOOLS

[75] Inventor: Jeong-Tae Kim, Koyang-Si, Rep. of Korea

[73] Assignee: Daewoo Electroniccs Co., Ltd., Seoul, Rep. of Korea

[21] Appl. No.: 08/773,869

[22] Filed: Dec. 27, 1996

[30] Foreign Application Priority Data

Dec. 29, 1995 [KR] Rep. of Korea ..... 95-66360
Dec. 29, 1995 [KR] Rep. of Korea ..... 95-66361

[51] Int. Cl.[7] ..... G05G 9/047

[52] U.S. Cl. ..... 74/471 XY; 74/471 R; 901/16

[58] Field of Search ..... 74/471 XY, 469, 74/471 R; 901/16, 23, 25, 34

[56] References Cited

U.S. PATENT DOCUMENTS

| | | | |
|---|---|---|---|
| 3,091,130 | 5/1963 | Payerle et al. | 74/471 XY |
| 3,561,280 | 2/1971 | MacPhee et al. | 74/471 XY |
| 4,216,467 | 8/1980 | Colston . | |
| 4,641,123 | 2/1987 | Whitehead | 74/471 XY |
| 5,223,776 | 6/1993 | Radke et al. | 74/471 XY |
| 5,228,356 | 7/1993 | Chuang | 74/471 XY |
| 5,271,290 | 12/1993 | Fischer | 74/471 XY |

FOREIGN PATENT DOCUMENTS 2261052 5/1993 United Kingdom .

*Primary Examiner*—Charles A. Marmon
*Assistant Examiner*—David M. Fenstermacher
*Attorney, Agent, or Firm*—Anderson, Kill & Olick, P.C.

[57] ABSTRACT

A manipulator having six degrees of freedom includes a moving plate having six moving points arranged with substantial equal angles therebetween, an upper fixed plate having six upper fixed points arranged with substantial equal angles therebetween, the upper fixed plate being positioned above the moving plate and being spaced apart from the moving plate, a lower fixed plate having six lower fixed points arranged with substantial equal angles therebetween, the lower fixed plate being positioned under the moving plate and being spaced apart from the moving plate. In order to connect one moving point to one upper fixed point and one lower fixed point, respectively, thereby enabling the moving plate to move relatively to the upper and the lower fixed plates with six degrees of freedom and to detect distance variations between the one moving point and the one upper fixed point, and between the one moving point and the one lower fixed point, when the moving plate moves, the manipulator includes a first spool, a second spool, a first wire, a second wire, a first shaft encoder and a second shaft encoder.

7 Claims, 7 Drawing Sheets

FORCE FEED BACK MANIPULATOR EMPLOYING WIRES AND SPOOLS

FIELD OF THE INVENTION

The present invention is directed to a force feed back manipulator having six degrees of freedom; and, more particularly, to a force feed back manipulator having a reduced size and being capable of determining parameters required to control a position and an orientation of an object in a three dimensional space by employing wires and spools.

DESCRIPTION OF THE PRIOR ART

Referring to FIG. 1, there is shown a prior art parallel manipulator 10 employing hydraulic cylinders. The manipulator 10 has a triangular fixed plate 18 and a triangular moving plate 12 positioned above the fixed plate 18 with a separation therebetween. Six hydraulic cylinders 16*a*, 16*b*, 16*c*, 16*d*, 16*e* and 16*f* connect the moving plate 12 to the fixed plate 18. Through the cylinders 16*a*, 16*b*, 16*c*, 16*d*, 16*e* and 16*f*, the moving plate 12 is able to move with six degrees of freedom with respect to the fixed plate 18, wherein the six degrees of freedom referes three translational movements along X, Y and Z axis in rectangular coordinates and three rotational movements about the three axis.

If an operator changes the position and/or orientation of the moving plate 12 by using a control stick (not shown) on the moving plate 12, the six hydraulic cylinders 16*a*, 16*b*, 16*c*, 16*d*, 16*e* and 16*f* experience variations in their length, respectively. The six length variations of the hydraulic cylinders 16*a*, 16*b*, 16*c*, 16*d*, 16*e* and 16*f* which indicate how the moving plate 12 was moved with respect to the fixed plate 18 are measured by a detection device (not shown). The measured values are data which a simulator or movement reproducing system requires in understanding and reproducing the position or the orientation changes of the moving plate 12.

The manipulator structured in this manner, however, is too large in size to be used with a small sized simulator or the like because it employs hydraulic cylinders.

Another prior art manipulator 20 for overcoming the shortcoming in the hydraulic cylinder type manipulator 10 is shown in FIG. 2. The manipulator 20 includes a moving plate 24 having a control stick 22 and a fixed plate 28. The moving plate 24 is connected to the fixed plate 28 through three link assemblies 34*a*, 34*b* and 34*c* which connect three frames 28*a*, 28*b* and 28*c* on the fixed plate 28 to three universal joints (only 32*a* and 32*b* are shown).

One link assembly 34*a* includes four links and is hinged to the universal joint 32*a* and the frame 28*a*. Mounted on the frame 28*a* are a sun gear 30*a* rotatable about a crossing of the links, and two planetary gears 38*a* and 38*b* engaged with the sun gear 30*a*. The planetary gears 38*a* and 38*b* are connected to shafts of DC motors 40, respectively. Each of the DC motors 40 has a shaft encoder 42 which detects a rotation of the planetary gear. When the moving plate 24 moves freely, the links move in response to the movement of the moving plate 24, rotating the planetary gears 38*a* and 38*b* around the sun gear 30*a*. The rotation of the planetary gears 38*a* and 38*b* are detected by the shaft encoders 42 and sent to an electronic control unit (not shown).

As well known in the art, however, only six detected values by the shaft encoders 42 of the planetary gears 38*a* and 38*b* cannot indicate completely the movements of the moving plate 24. Therefore, the shaft of the frame 28*a* must be provided with another shaft encoder 42 which detects a rotation thereof.

While the manipulator employing links described above is capable of performing its assigned task, needs have continued to exist for an improved manipulator in that the links and gears used in the prior art manipulator tend to hinder a smooth manipulation of the moving plate with respect to the fixed plate.

SUMMARY OF THE INVENTION

It is, therefore, a primary object of the invention to provide a force feed back manipulator having a reduced size and being capable of allowing a moving plate to softly move with respect to a fixed plate.

The above and other objects of the invention are accomplished by providing a manipulator of six degrees of freedom comprising: a moving plate having six moving points arranged with substantial equal angles therebetween; an upper fixed plate having six upper fixed points arranged with substantial equal angles therebetween, the upper fixed plate being positioned above the moving plate and being spaced apart from the moving plate; a lower fixed plate having six lower fixed points arranged with substantial equal angles therebetween, the lower fixed plate being positioned under the moving plate and being spaced apart from the moving plate; and six connection and detection means each of which connects one of the six moving points to one of the six upper fixed points and to one of the six lower fixed points, respectively, thereby enabling the moving plate to move relative to the upper and the lower fixed plates with six degrees of freedom and each of which detects distance variations between said one moving point and said one upper fixed point, and between said one moving point and said one lower fixed point, when the moving plate moves.

BRIEF DESCRIPTION OF THE DRAWINGS

The above and other objects and features of the instant invention will become apparent from the following description of preferred embodiments taken in conjunction with the accompanying drawings, in which.

DETAILED DESCRIPTION OF THE PREFERRED EMBODIMENTS

Figure 1:
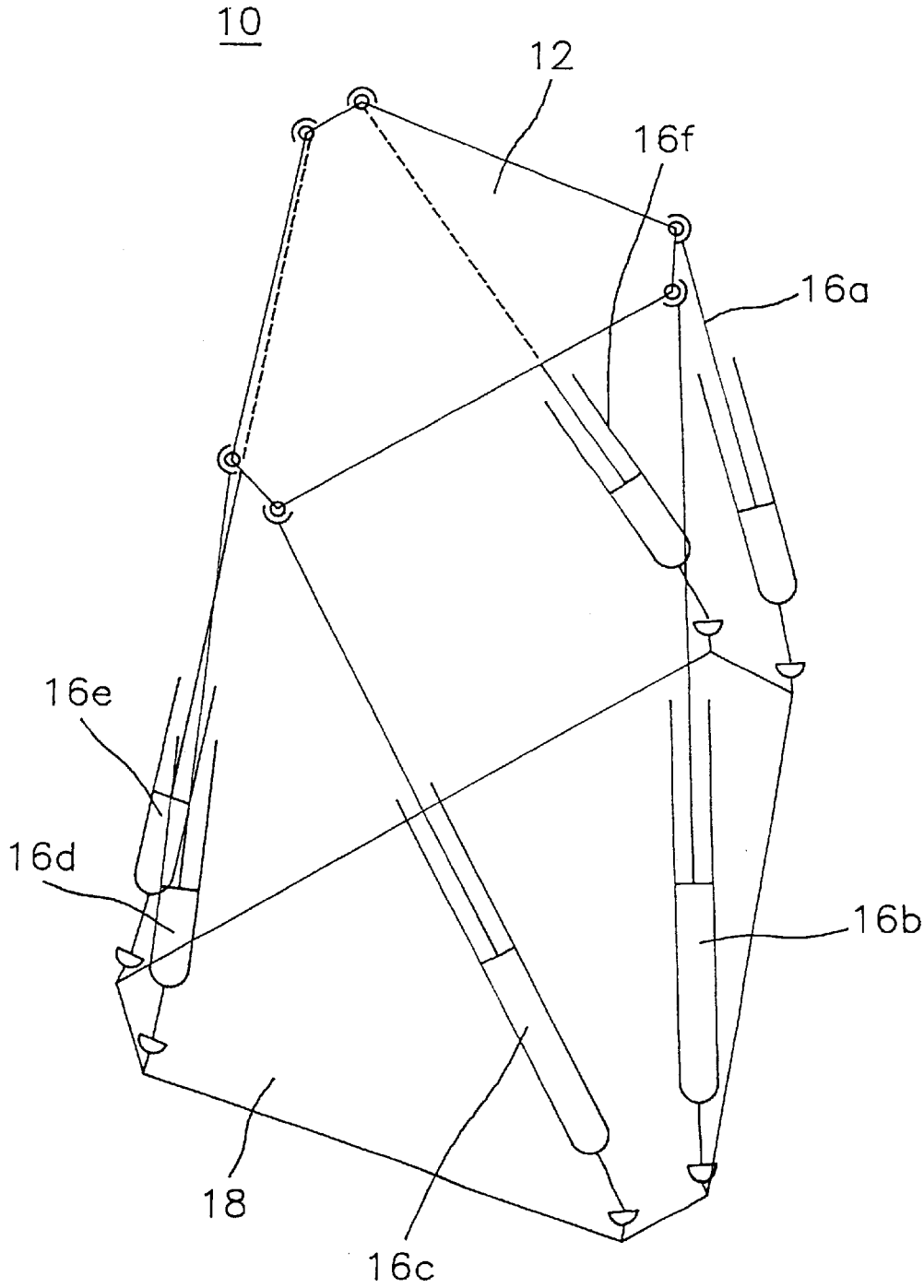
FIG. 1 (PRIOR ART)
FIG. 1 shows a schematic view of a prior art parallel manipulator employing hydraulic cylinders.
Figure 2:
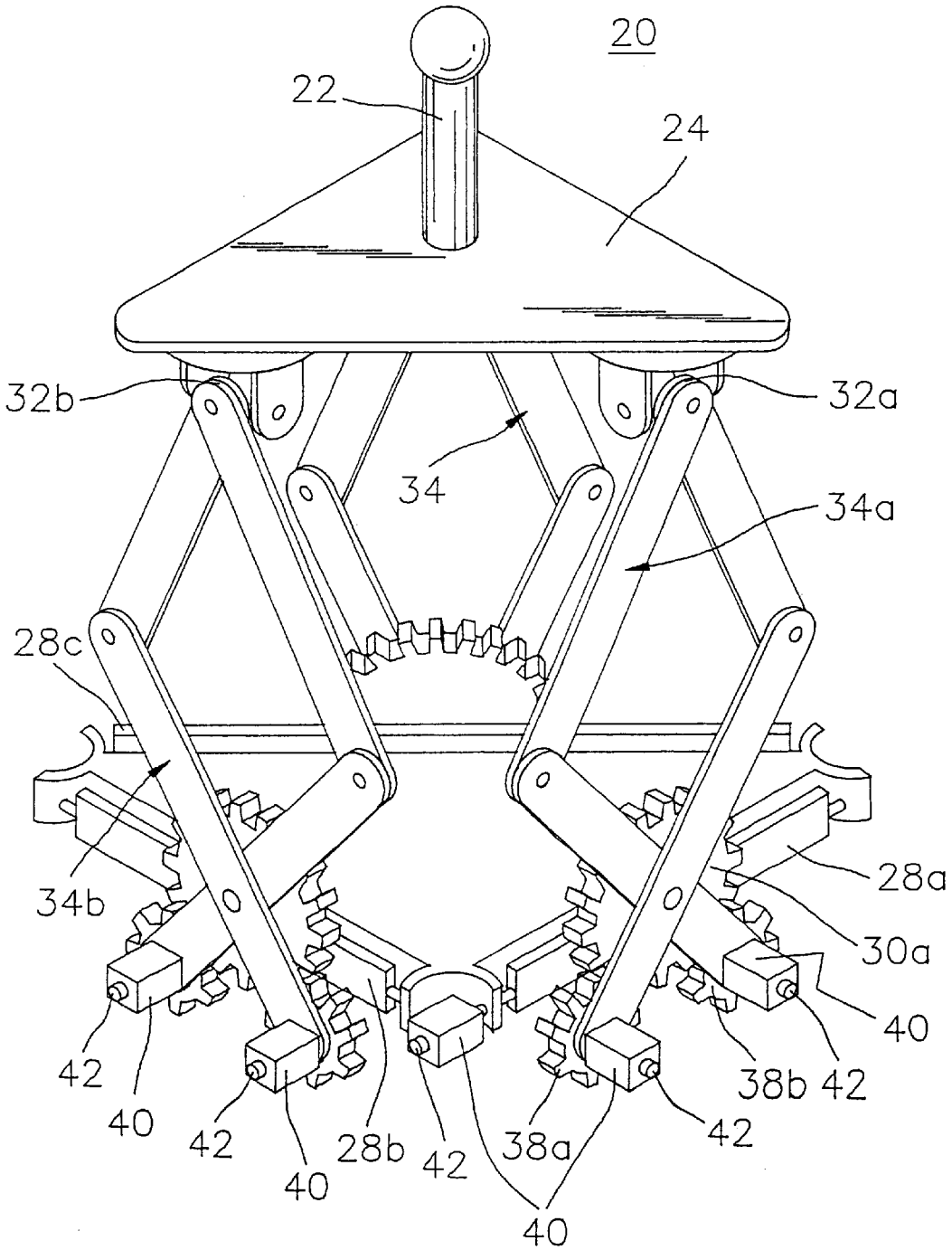
FIG. 2 (PRIOR ART)
FIG. 2 represents a perspective view of a prior art parallel manipulator employing links.
Figure 3:
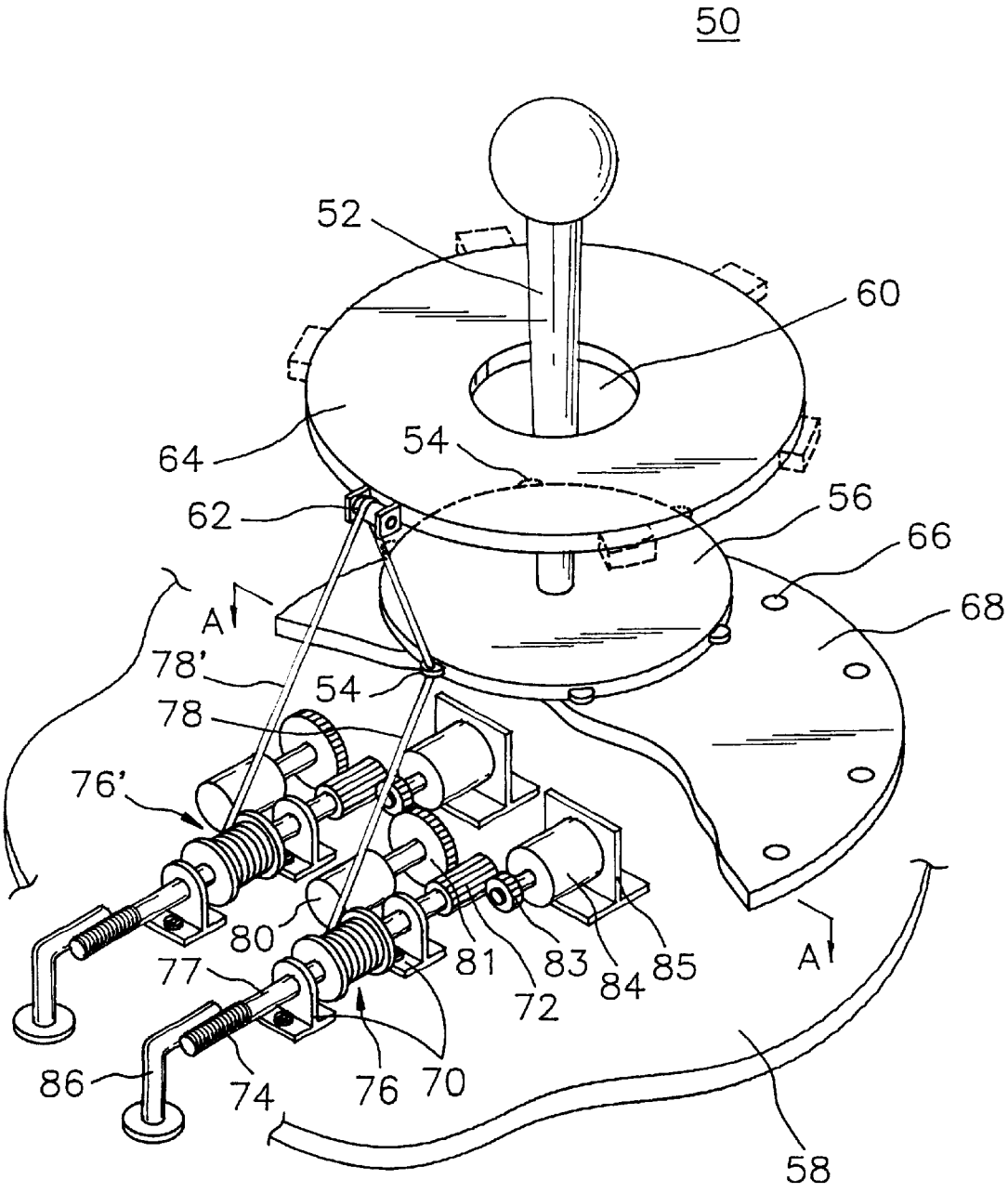
FIG. 3 illustrates a perspective view of a force feed back manipulator having six degrees of freedom in accordance with the present invention.

FIG. 3 shows a perspective view of a first embodiment of an inventive force feed back manipulator 50. The inventive manipulator 50 has four plate-shaped components 64, 56, 68 and 58 vertically spaced apart from each other. A moving plate 56 is positioned between an upper fixed plate 64 of a donut shape and a lower fixed plate 58, the moving plate 56 being spaced apart from both fixed plates 64 and 58. The moving plate 56 has six anchor portions 54 on its circumferential surface, which are angularly equally arranged with respect to each other. A first and a second wires 78' and 78 are fixed to an upper and a lower portions of each of the anchor portions 54. The moving plate 56 further has a handling stick 52 vertically extending from an upper surface thereof to pass through a through-hole 60 of the upper fixed plate 64.

The upper fixed plate 64 has six wire rollers 62 which six first wires 78' pass through, the six first wires 78 being wound therearound. The six wire rollers 62 are angularly equally arranged on the upper fixed plate 64. The upper fixed plate 64 is fixed to a housing (not shown) of the manipulator 50.

Figure 4:
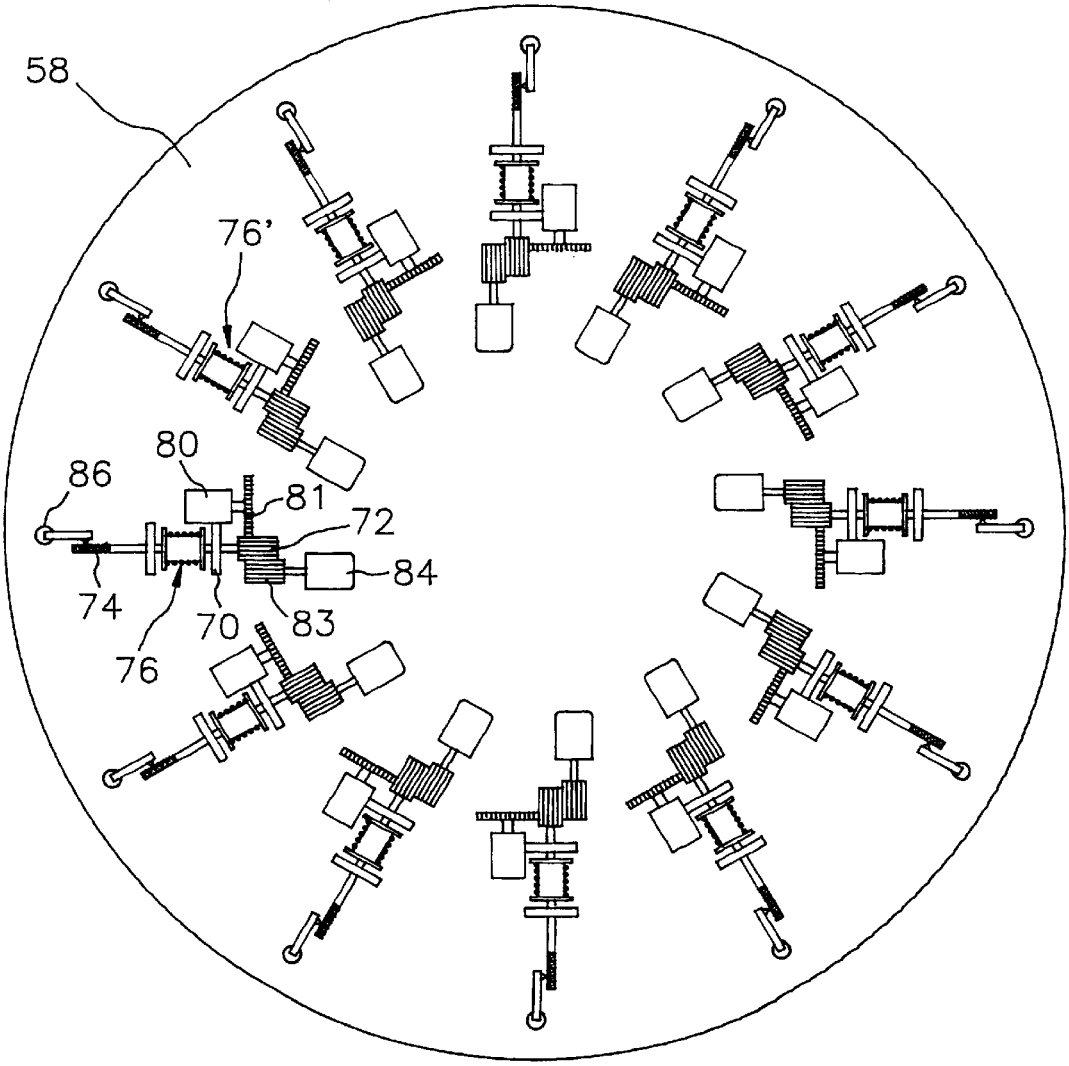
FIG. 4 depicts a sectional view of the inventive manipulator, when taken along a line A-A' in FIG. 3.

Each of the first wires 78' fixed to one of the anchor portions 54 is wound around a first spool 76' through one of the wire rollers 62. Each of the second wires 78 fixed to one of the anchor portion 54 is wound around a second spool 76. The first and the second spools 76' and 76 are mounted on the lower fixed plate 58. As shown in FIG. 4, on the lower fixed plate 58 fixed to the housing, six first spools 76' and six second spools 76 are radially arranged in an alternating manner.

The first spool 76' and the second spool 76, as components around which the first and the second wires 78' and 87 are wound, respectively, are identical in structure. Detailed description of the spool is made referring to the second spool 76.

Figure 5A:
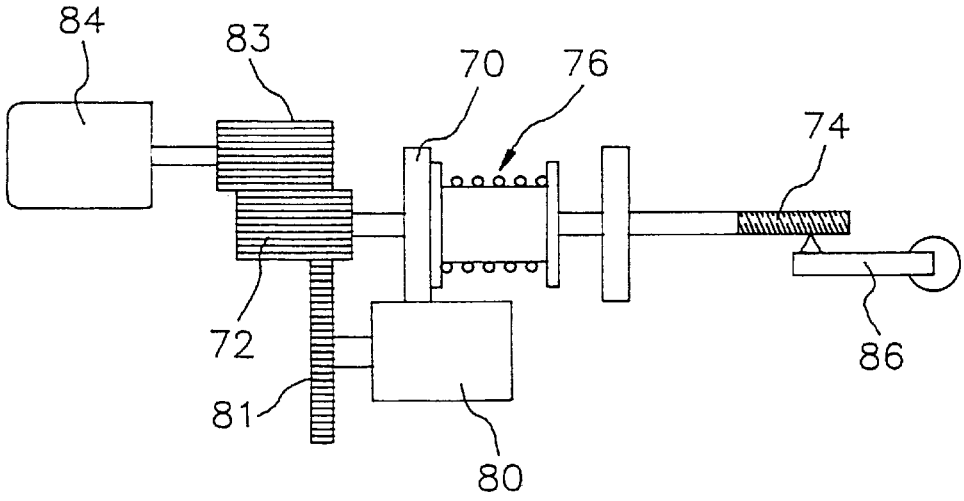
FIGS. 5A and 5B present schematic views showing longitudinal back and forth movements of a spool of the inventive manipulator.
Figure 5B:
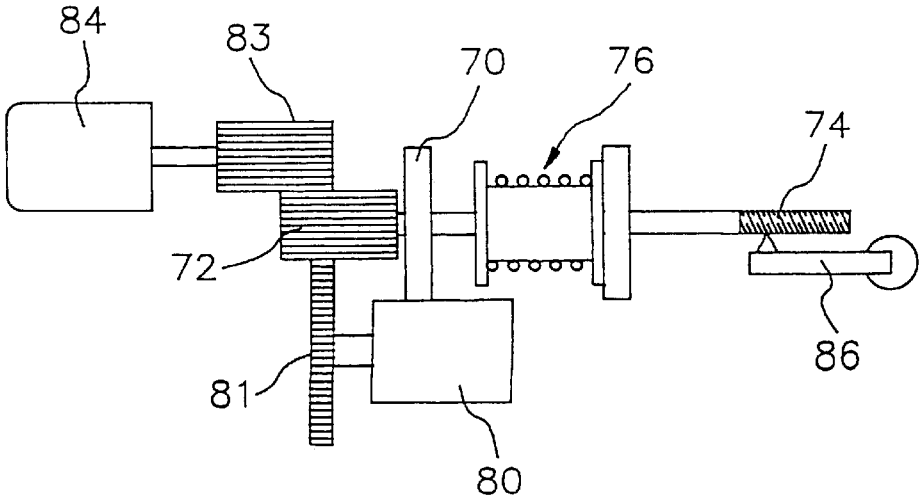

The second spool 76 and its rotation shaft 77 are mounted on the lower fixed plate 58 via a bracket 70 in such a manner that they are rotatable and movable in a direction of the rotation shaft 77. In accordance with the present invention, in order for the second wire 76 to be uniformly wound around the second spool 76, not being overlapped, a winding guide post 86 is prepared on the lower fixed plate 58. The winding guide post 86 is engaged with a helical portion 74 on one end of the rotation shaft 77 so that the rotation shaft 77 moves longitudinally and correspondingly to the rotation direction thereof. A spline gear 72 is fixed around the other end of the rotation shaft 77. The spline gear 72 is engaged with an encoder gear 81 connected to an encoder 80 and a motor gear 83 connected to a driving motor 84. The driving motor 84 is to resist the movement of the moving plate 56 by rotating the second spool 76 depending on a signal from an electronic control unit (ECU). The driving motor 84 is fixed on the lower fixed plate 58 via a bracket 85. The second spool 76 constructed in this manner is rotated, when the second wire 78 is drawn or when the driving motor 84 drives it. As shown in FIGS. 5A and 5B, the second spool 76 and the rotation shaft 77 moves toward the driving motor 84 or toward the winding guide post 86 depending upon the rotation direction thereof.

Returning to FIG. 3, a guide plate 68 of a circular shape is positioned between the moving plate 56 and the lower fixed plate 58. The guide plate 68 has twelve guiding holes 66 through which the six first wires 78' and the six second wires 78 pass.

Operations of the inventive manipulator is described with reference to FIGS. 3 and 5.

When an operator manipulates the handling stick 52 and moves the moving plate 56, e.g., upward, downward, laterally, and back and forth, or rotationally, the first and the second wires 78' and 78 are selectively drawn in response to the movement of the anchor portions 54 on the moving plate 56, thereby rotating the first and the second spools 76' and 76. The rotations of the spools 76' and 76 are detected by the encoders 80 through the encoder gear 81 engaged with the spline gear 72. The detected values by the encoders 80 are sent to the ECU. Values processed by the ECU may be used as an input information for a simulating system, a computer game or a movement reproducing device.

Figure 7:
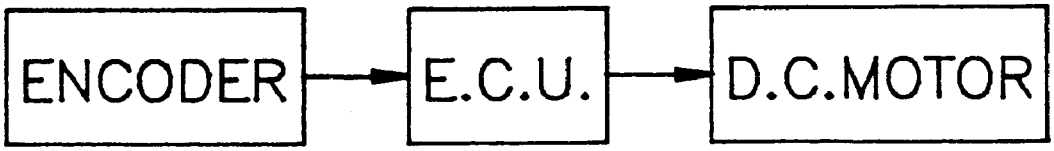
FIG. 7 is a block diagram showing a force feed back conception of the inventive manipulator.

On the other hand, in accordance with the present invention, when every movement of the moving plate 56 is made, a reverse load which hinders the movement of the moving plate 56 may be applied by the driving motor 84. As shown in FIG. 7, this "force feed back" is obtained in such a manner that when the moving plate 56 moves, information on the moving plate movement is first sent to the ECU from the encoders 80, and the ECU performs a predetermined operations to determine values for the force feed back and sends the values to the driving motors 84, respectively. The force feed back function may be needed in virtual reality systems.

Figure 6:
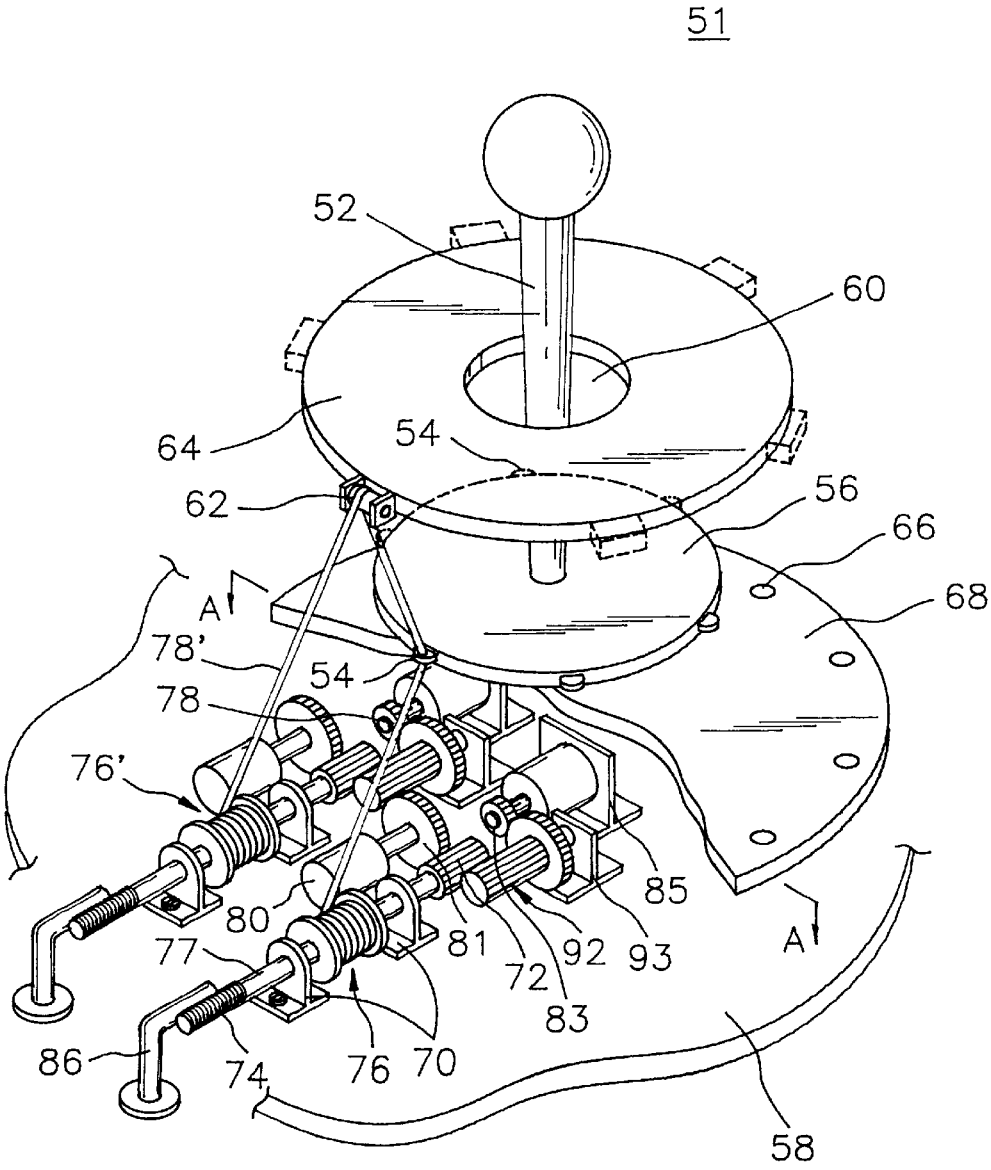
FIG. 6 offers a perspective view of a second embodiment of the inventive manipulator.

In FIG. 6, there is shown a second embodiment 51 of the inventive manipulator. The second embodiment 51 is identical to the first embodiment but further comprises twelve intermediate gears 92 on brackets 93 each of which is positioned between the driving motor 84 and the spool 76. The intermediate gear 92 provides a proper gear ratio between the motor gear 83 and the spline gear 72 to thereby permit efficient power train between them.

Although the invention has been shown and described with respect to the preferred embodiments, it will be apparent to those skilled in the art that various changes and modifications may be made without departing from the spirit and scope of the invention as defined in the following claims.

What is claimed is:

1. A manipulator having six degrees of freedom comprising:

a moving plate having six moving points arranged with substantial equal angles therebetween;

an upper fixed plate having six upper fixed points arranged with substantial equal angles therebetween, the upper fixed plate being positioned above the moving plate and being spaced apart from the moving plate;

a lower fixed plate having six lower fixed points arranged with substantial equal angles therebetween, the lower fixed plate being positioned under the moving plate and being spaced apart from the moving plate;

six connection and detection devices, each connecting one of the six moving points to one of the six upper fixed points and to one of the six lower fixed points, respectively, for moving the moving plate relative to the upper and the lower fixed plates with six degrees of freedom and detecting distance variations when the moving plate moves between said one moving point and said one upper fixed point, and between said one moving point and said one lower fixed point, and wherein each connection and detection means includes:

a first spool and a second spool rotatably mounted on the lower fixed plate and longitudinally movable by a winding guide means, and each spool having a rotation shaft and a power transmitting means on said rotation shaft;

a first wire wound around the first spool and connected to one moving point via one upper fixed point;

a second wire wound around the second spool and connected to said one moving point to which the first wire is connected;

a first shaft encoder for detecting a rotation of the first spool and connected to the power transmitting means of the first spool; and a second shaft encoder for detecting a rotation of the second spool and connected to the power transmitting means of the second spool;

a through-hole formed through the upper fixed plate; and a handling stick vertically extending from an upper surface of the moving plate to pass through said through-hole.

2. The manipulator having six degrees of freedom of claim 1, wherein said winding guide means of the first spool and the second spool comprises:

a first helical portion and a second helical portion formed on one end of the rotation shafts of the first spool and the second spool, respectively;

a first winding guide post fixedly mounted on the lower fixed plate, being engaged with the first helical portion to thereby move the rotation shaft of the first spool longitudinally in response to a rotational movement of the rotation shaft of the first spool; and a second winding guide post fixedly mounted on the lower fixed plate, being engaged with the second helical portion to thereby move the rotation shaft of the second spool longitudinally in response to a rotational movement of the rotation shaft of the second spool.

3. The manipulator of six degrees of freedom of claim 1, wherein each of the power transmitting means of the first spool and the second spool is a spline gear.

4. The manipulator having six degrees of freedom of claim 1, wherein each of the connection and detection means further comprises:

a first driving motor connected to the power transmitting means of the first spool; and a second driving motor connected to the power transmitting means of the second spool.

5. The manipulator having six degrees of freedom of claim 4, wherein each of the connection and detection means further comprises:

a first intermediate gear connected to the power transmitting means of the first spool at one end of the first intermediate gear and connected to the first driving motor at the other end; and a second intermediate gear connected to the power transmitting means of the second spool at one end of the second intermediate gear and connected to the second driving motor at the other end.

6. The manipulator having six degrees of freedom of claim 5, wherein a guide plate is positioned between the moving plate and the lower fixed plate, the guide plate having twelve guiding holes through which said first wires and said second wires pass.

7. A manipulator having six degrees of freedom, comprising:

a moving plate having six moving points arranged with substantial equal angles therebetween;

an upper fixed plate having six upper fixed points arranged with substantial equal angles therebetween, the upper fixed plate being positioned above the moving plate and being spaced apart from the moving plate;

a lower fixed plate having six lower fixed points arranged with substantial equal angles therebetween, the lower fixed plate being positioned under the moving plate and being spaced apart from the moving plate; and six connection and detection devices, each connecting one of the six moving points to one of the six upper fixed points and to one of the six lower fixed points, respectively, for moving the moving plate relative to the upper and the lower fixed plates with six degrees of freedom and detecting distance variations when the moving plate moves between said one moving point and said one upper fixed point, and between said one moving point and said one lower fixed point, and wherein each connection and detection means includes:

a first spool and a second spool rotatably mounted on the lower fixed plate and longitudinally movable by a winding guide means, and each spool having a rotation shaft and a power transmitting means on said rotation shaft;

a first wire wound around the first spool and connected to one moving point via one upper fixed point;

a second wire wound around the second spool and connected to said one moving point to which the first wire is connected;

a first shaft encoder for detecting a rotation of the first spool and connected to the power transmitting means of the first spool; and a second shaft encoder for detecting a rotation of the second spool and connected to the power transmitting means of the second spool.

* * * * *